US007581351B2

(12) United States Patent
Lewis

(10) Patent No.: US 7,581,351 B2
(45) Date of Patent: Sep. 1, 2009

(54) SPEED BARRIER

(76) Inventor: Christopher Lewis, 3419 Via Lido, Newport Beach, CA (US) 92663

( * ) Notice: Subject to any disclaimer, the term of this patent is extended or adjusted under 35 U.S.C. 154(b) by 450 days.

(21) Appl. No.: 11/350,490

(22) Filed: Feb. 9, 2006

(65) Prior Publication Data

US 2007/0183845 A1 Aug. 9, 2007

(51) Int. Cl.
*E01F 13/00* (2006.01)

(52) U.S. Cl. ..... 49/49; 49/131; 49/132; 49/133; 49/134; 49/208; 49/240; 49/245; 49/260; 49/324; 49/339; 49/340; 49/388; 404/6

(58) Field of Classification Search ..... 49/131–134, 49/49, 208, 240, 245, 260, 324, 347, 339, 49/340, 388; 404/6
See application file for complete search history.

(56) References Cited

U.S. PATENT DOCUMENTS

| | | | | | |
|---|---|---|---|---|---|
| 303,444 | A | * | 8/1884 | McCutchan | 49/134 |
| 1,579,588 | A | * | 4/1926 | Wolff | 49/131 |
| 1,617,680 | A | * | 2/1927 | Funcheon | 49/131 |
| 1,690,972 | A | | 11/1928 | Geohring | |
| 1,713,235 | A | * | 5/1929 | Lowance | 49/131 |
| 1,944,349 | A | | 1/1934 | Kincaid | |
| 2,143,704 | A | * | 1/1939 | Frantisek | 16/358 |
| 3,303,613 | A | | 2/1967 | Seuntjens | |
| 3,775,912 | A | | 12/1973 | Walls | |
| 4,148,156 | A | * | 4/1979 | Lubmann | 49/131 |
| 4,164,095 | A | * | 8/1979 | Musacchia | 52/1 |
| 4,475,310 | A | | 10/1984 | Brewer | |
| 4,576,509 | A | * | 3/1986 | Beaty, Sr. | 404/6 |
| 4,705,426 | A | * | 11/1987 | Perea | 404/6 |
| 4,792,258 | A | * | 12/1988 | Goff | 404/6 |
| 4,828,424 | A | * | 5/1989 | Crisp, Sr. | 404/6 |
| 4,850,737 | A | * | 7/1989 | Nasatka et al. | 404/6 |
| 4,858,382 | A | * | 8/1989 | Ellgass | 49/35 |
| 5,012,612 | A | * | 5/1991 | Kille | 49/254 |
| 5,131,631 | A | | 7/1992 | Cobbe | |
| 5,245,787 | A | * | 9/1993 | Swenson et al. | 49/34 |
| 5,309,675 | A | * | 5/1994 | Shen et al. | 49/214 |
| 5,466,088 | A | * | 11/1995 | Nasatka | 404/6 |
| 5,704,730 | A | * | 1/1998 | Burton-Chambers | 404/6 |
| 5,975,791 | A | * | 11/1999 | McCulloch | 404/6 |
| 5,993,104 | A | * | 11/1999 | Marcotullio et al. | 404/6 |
| 6,100,818 | A | * | 8/2000 | Di Berardino | 340/932.2 |
| 6,115,964 | A | | 9/2000 | Hix | |
| 6,227,523 | B1 | * | 5/2001 | Haberlen | 256/59 |
| 6,837,296 | B2 | | 1/2005 | Kimener | |
| 6,997,638 | B2 | * | 2/2006 | Hensley et al. | 404/6 |
| 7,329,067 | B1 | * | 2/2008 | Rodriguez | 404/6 |
| 7,384,017 | B1 | * | 6/2008 | Burke et al. | 246/125 |

* cited by examiner

*Primary Examiner*—Katherine W Mitchell
*Assistant Examiner*—Jeff Tang
(74) *Attorney, Agent, or Firm*—Kenneth L. Green; Edgar W. Averill, Jr.

(57) ABSTRACT

A speed barrier includes a heavy lower barrier and a lighter upper gate. The barrier and gate may normally be positioned to allow or to restrict passing of vehicles. The barrier is configured to receive and survive the main impact of a vehicle attempting to ram through the speed barrier. The gate and barrier are coupled to allow an extension or a retraction of the gate and barrier in unison. The barrier and gate are supported by left and right columns, and an upper end of the gate is supported by the columns when the gate and barrier are extended.

17 Claims, 11 Drawing Sheets

SPEED BARRIER

BACKGROUND OF THE INVENTION

The present invention relates to security gates and in particular to gates resisting passing of a vehicle.

Access to a secure location is often accomplished by ramming a vehicle through a gate. In some instances, a gate may be manned by armed guards, but if the vehicle contains bombs, the guards may be severely injured or killed in the process of preventing entry of the vehicle. In other instances, the gate may be difficult to open and close, and therefore cause delays in the entry of visitors.

BRIEF SUMMARY OF THE INVENTION

The present invention addresses the above and other needs by providing a speed barrier which includes a heavy lower barrier and a lighter upper gate. The barrier and gate may normally be positioned to allow or to restrict passing of vehicles. The barrier is configured to receive and survive the main impact of a vehicle attempting to ram through the speed barrier. The gate and barrier are coupled to allow an extension or a retraction of the gate and barrier in unison. The barrier and gate are supported by left and right columns, and an upper end of the gate is supported by the columns when the gate and barrier are extended.

In accordance with one aspect of the invention, there is provided a speed barrier comprising a left column, a right column, a gate, and a barrier. The gate is movable between a stowed gate position and a deployed gate position, wherein in the deployed gate position the gate resides vertically at an upper column position and is supported by the columns, and wherein the gate resides substantially horizontally when the gate is in the stowed gate position. Mid rollers attached to the gate between an upper end of the gate and a lower end of the gate. Vertical tracks attached to the columns, wherein the mid rollers translate along the vertical tracks when the gate moves between the stowed gate position and the deployed gate position. A linear actuator attached to the gate proximal to the mid rollers for moving the gate from the stowed gate position to the deployed gate position. A barrier is movable between a stowed barrier position and a deployed barrier position, wherein in the deployed position, the barrier resides vertically at a lower column position and is supported by the columns, and wherein the gate pulls the barrier from the stowed barrier position to the deployed barrier position.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
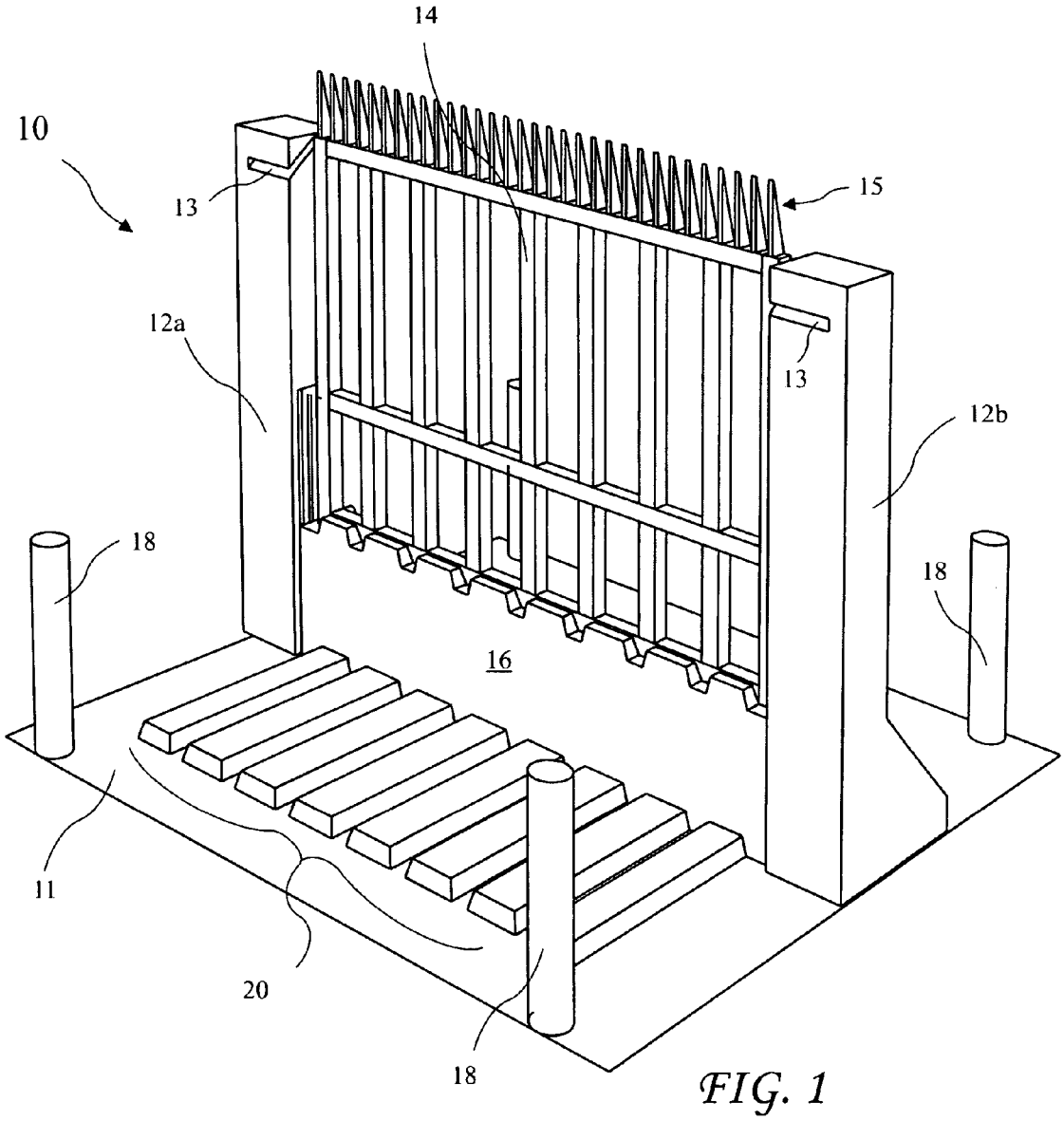
FIG. 1 is a perspective view of a speed barrier according to the present invention with a gate and a barrier deployed.

A perspective view of a speed barrier 10 according to the present invention is shown residing on a driving surface 11 in FIG. 1. The speed barrier 10 includes a gate 14 and a barrier 16 which are shown deployed to resist the entry of vehicles. Mouths 13 cooperate with engaging bars 26 (see FIG. 3) to resist motion of the gate 14 when a vehicle rams the gate 14. The gate 14 and barrier 16 are supported by left column 12*a* and right column 12. Posts 18 protect the columns 12*a* and 12*b*. A grid 20 cooperates with the gate 14 to provide a substantially flat surface for vehicles when the gate 14 is in a stowed gate position (see FIG. 5A). Spikes 15 along the top of the gate 14 resist climbing over the gate 14, and form a ramp for vehicles when the gate 14 is in the stowed gate position.

Figure 2:
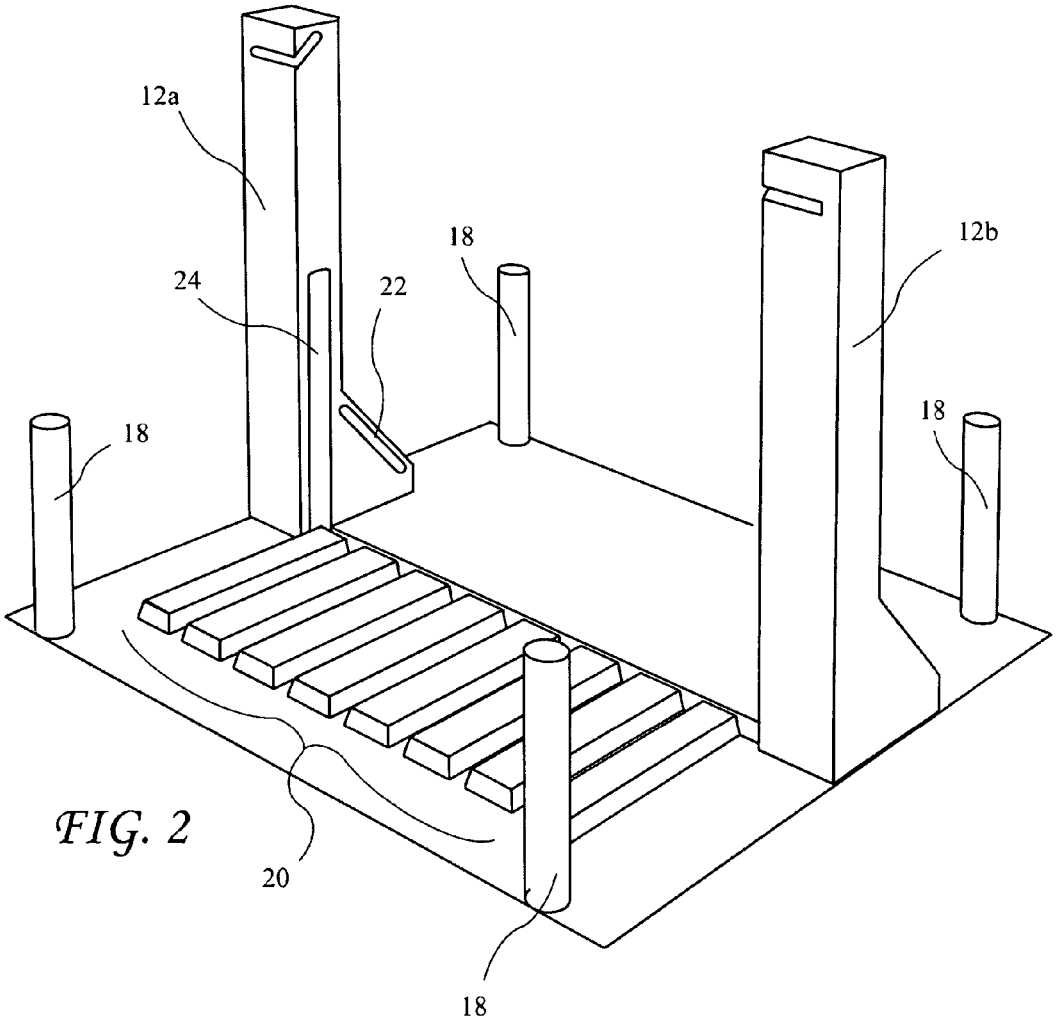
FIG. 2 depicts columns of the speed barrier.

The columns 12*a* and 12*b* are shown in FIG. 2 with the gate 14 and barrier 16 removed. The columns 12*a* and 12*b* include vertical openings 24 and diagonal openings 22. Elements of the gate 14 extend through the openings 22 and 24 to cooperate with tracks in the columns.

Figure 3:
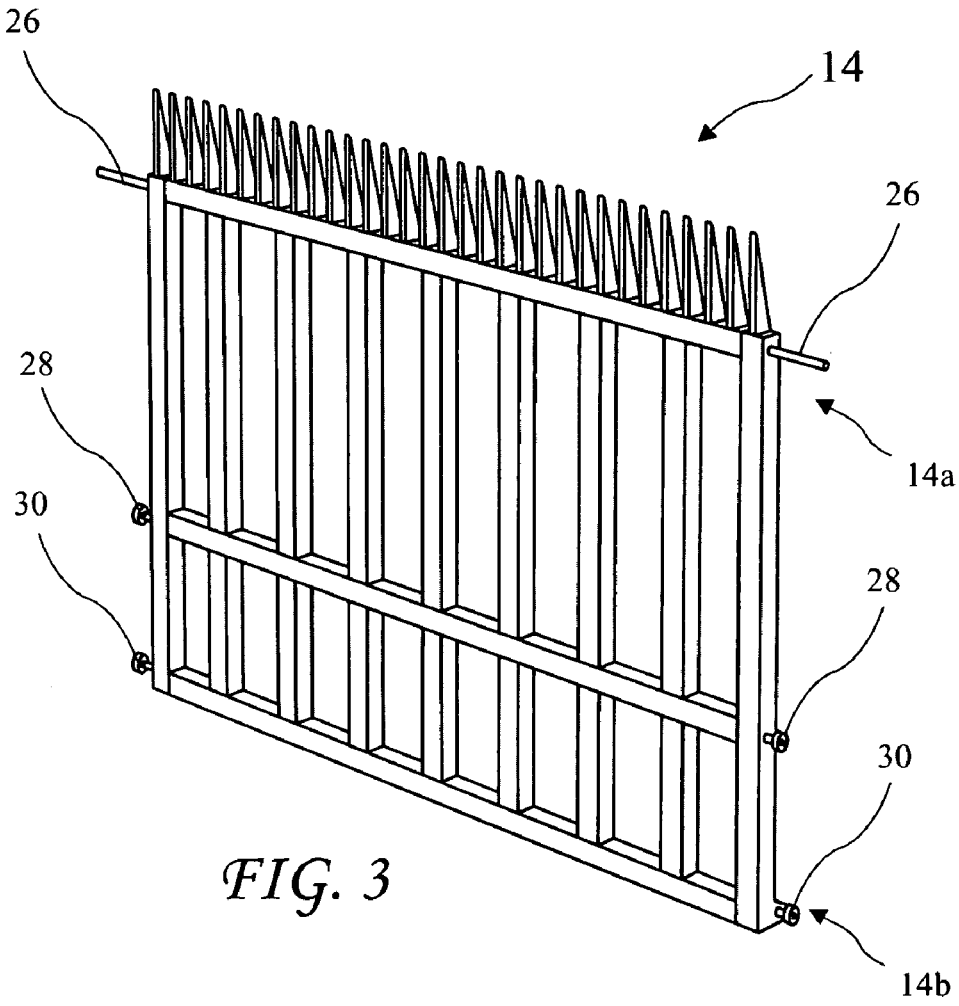
FIG. 3 is the gate of the speed barrier according to the present invention.

The gate 14 is shown in detail in FIG. 3. The gate 14 includes engaging bars 26 with cooperate with mouths 13 (see FIG. 1), mid rollers 28 which cooperate with vertical tracks 44 (see FIGS. 8B and 9), and the bottom rollers 30 which cooperate with diagonal tracks 42 (see FIGS. 8B and 9) or with "L" tracks (see FIGS. 10A and 10B).

Figure 4:
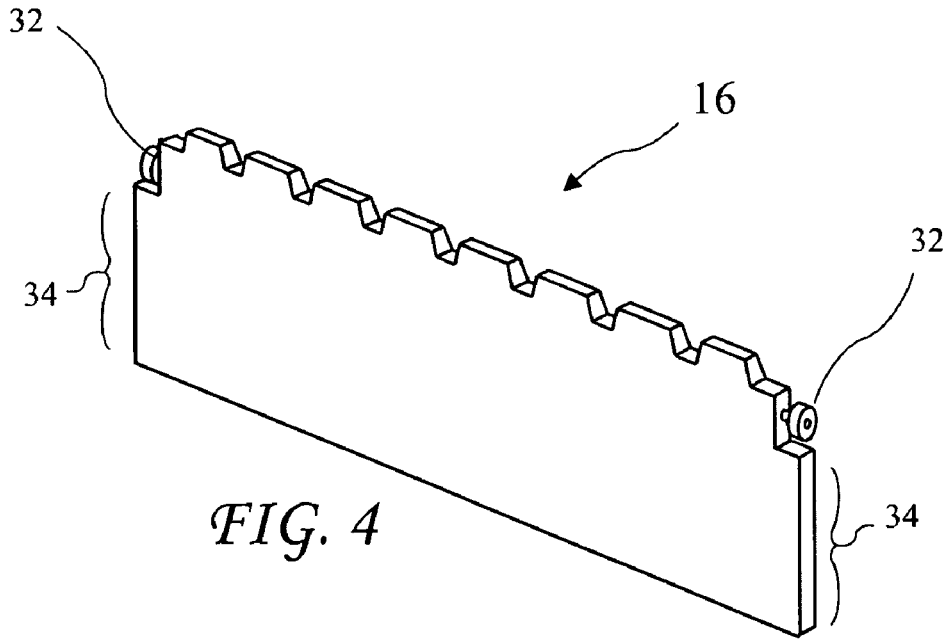
FIG. 4 is the barrier of the speed barrier according to the present invention.

The barrier 16 is shown in detail in FIG. 4. The barrier 16 includes barrier pulleys 32 on top outside corners, and barrier edges 34 which cooperate with the columns 12*a* and 12*b* to guide the barrier 16 when the barrier 16 is raised or lowered.

Figure 5C:
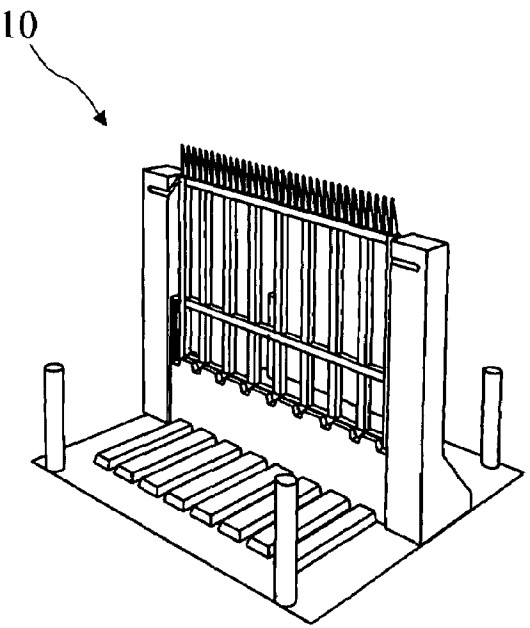
FIG. 5C depicts the speed barrier with the gate and barrier in deployed positions.
Figure 5B:
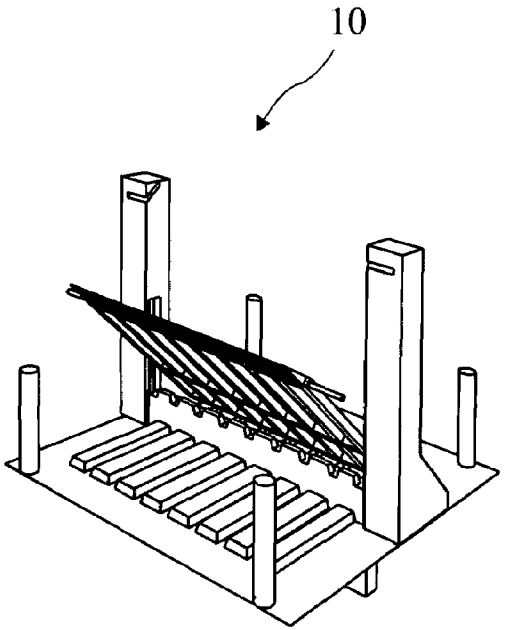
FIG. 5B depicts the speed barrier with the gate and barrier in intermediate positions.
Figure 5A:
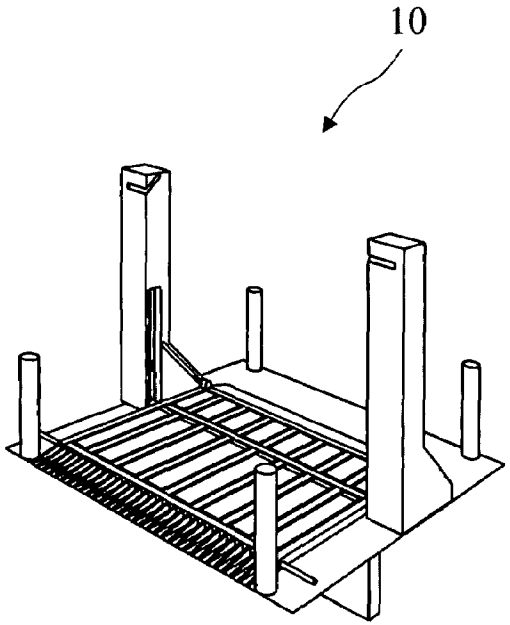
FIG. 5A depicts the speed barrier with the gate and barrier in stowed positions.

The speed barrier 10 is shown with the gate 14 and barrier 16 in stowed positions in FIG. 5A, in intermediate positions in FIG. 5B, and in deployed positions in FIG. 5C.

Figure 6:
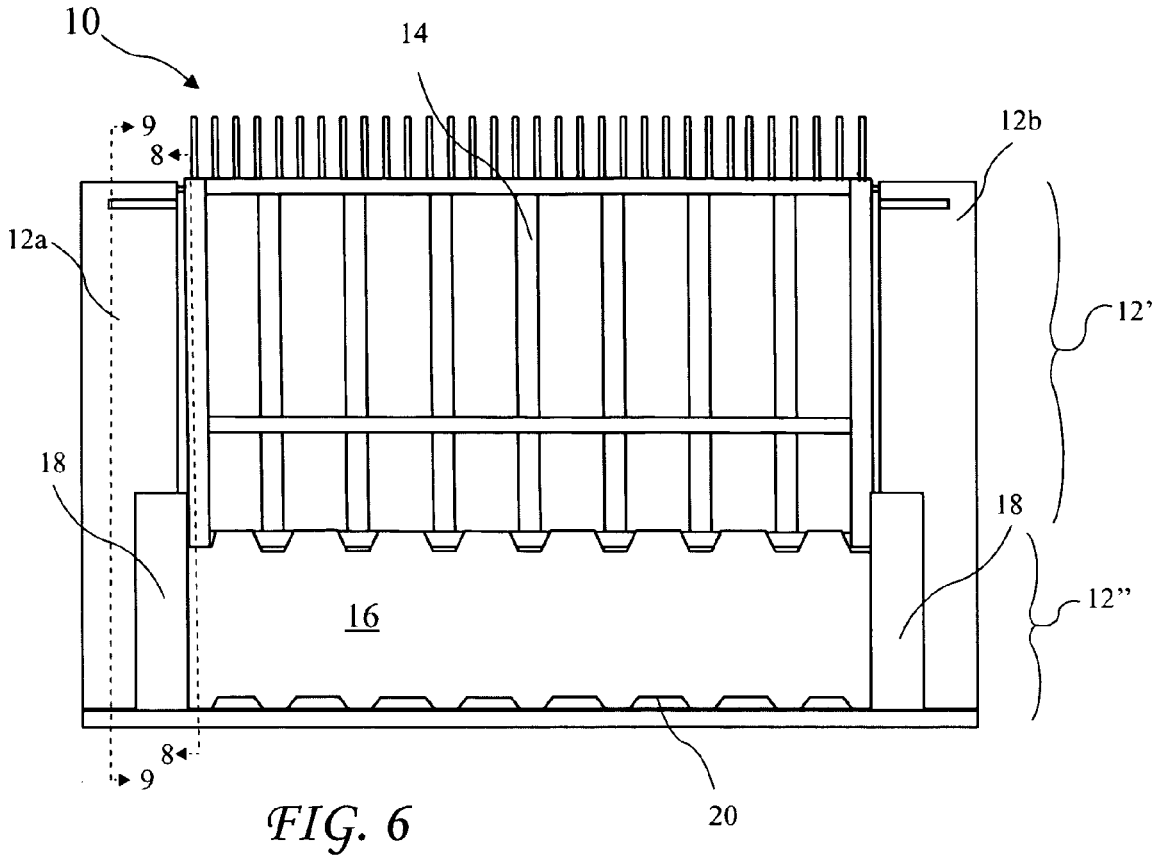
FIG. 6 is a front view of the speed barrier.
Figure 7:
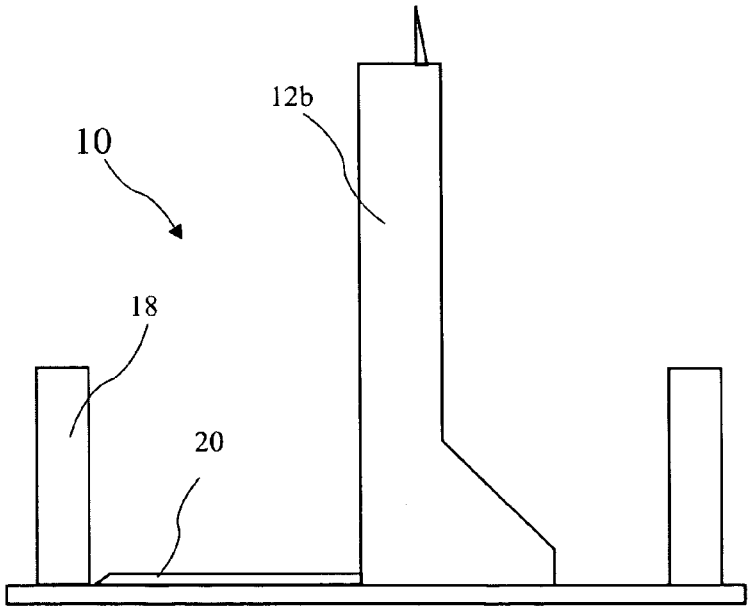
FIG. 7 is a side view of the speed barrier.
Figure 8A:
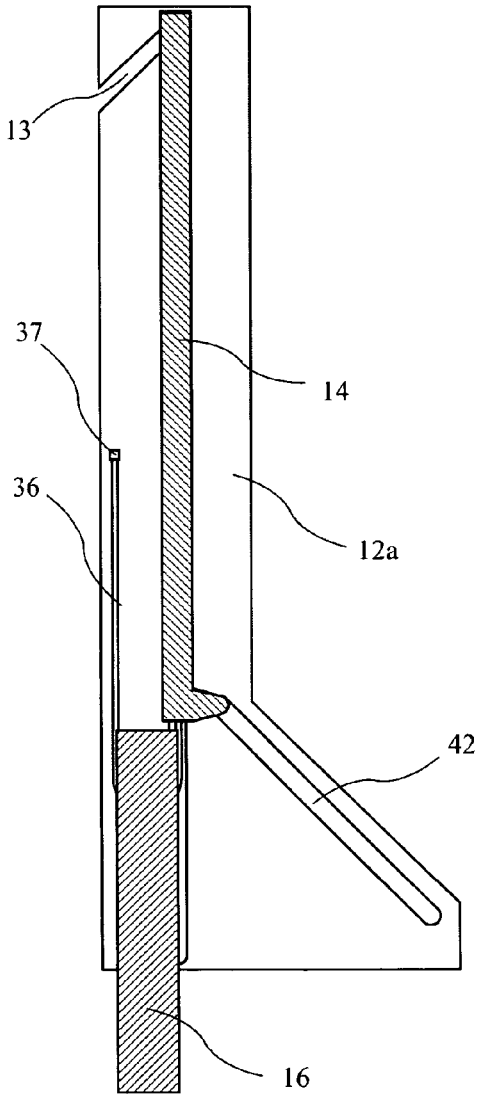
FIG. 8A is a cross-sectional view of the speed barrier taken along line 8-8 of FIG. 6.
Figure 8B:
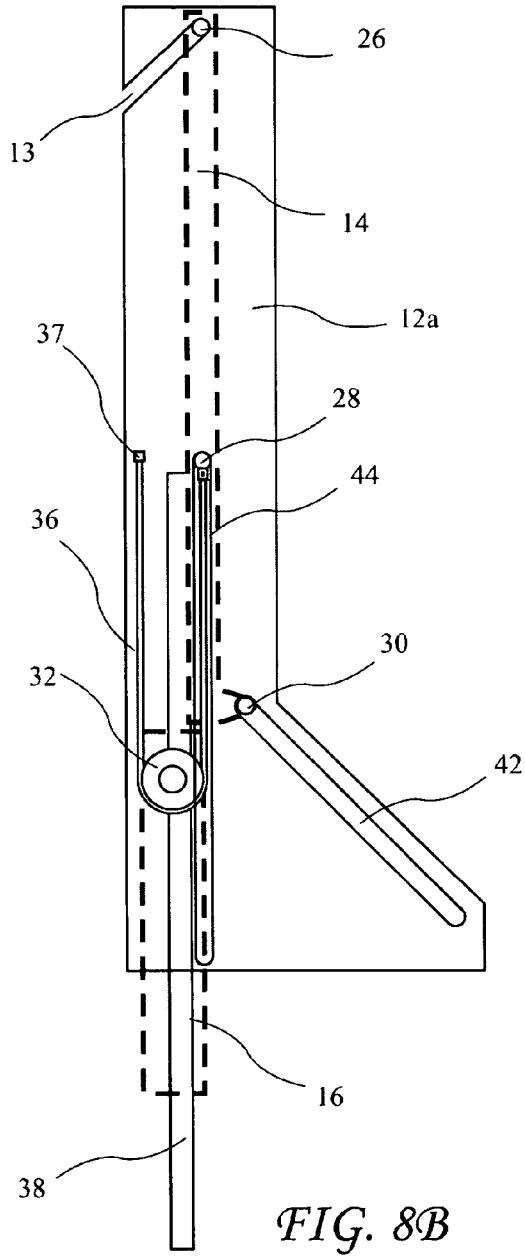
FIG. 8B is a second cross-sectional view of the speed barrier taken along line 8-8 of FIG. 6 with the gate and barrier shown as dashed lines to expose a cable an pulley.

A front view of the speed barrier 10 is shown in FIG. 6 and a side view of the speed barrier 10 is shown in FIG. 7. A first cross-sectional view of the speed barrier 10 taken along line 8-8 of FIG. 6 is shown in FIG. 8A. A second cross-sectional view of the speed barrier 10 taken along line 8-8 of FIG. 6 with the gate 14 and barrier 16 shown as dashed lines to expose a cable 36 and the barrier pulley 32 is shown in FIG. 8B. The gate 14 and the barrier 16 are in the deployed positions with the gate 14 in an upper column position 12' and the barrier 16 in a lower column position 12", and a portion of the barrier 16 is seen to extend below the columns 12*a* and 12*b* (and thus below the driving surface 11) to add stability to the barrier 16. The cable 36 is attached to the gate 14 proximal to the mid rollers 28, and is fixed to the columns 12*a* and 12*b* at fixed cable attachment 37. A linear actuator 38 connects to the gate 14 proximal to the mid roller 28. The gate 14 is thus raised and lowered by the linear actuator 38. The connection of the barrier 16 to the gate 14 via the pulley 32 results in the barrier 16 raising as half the rate of the gate 14.

Figure 9:
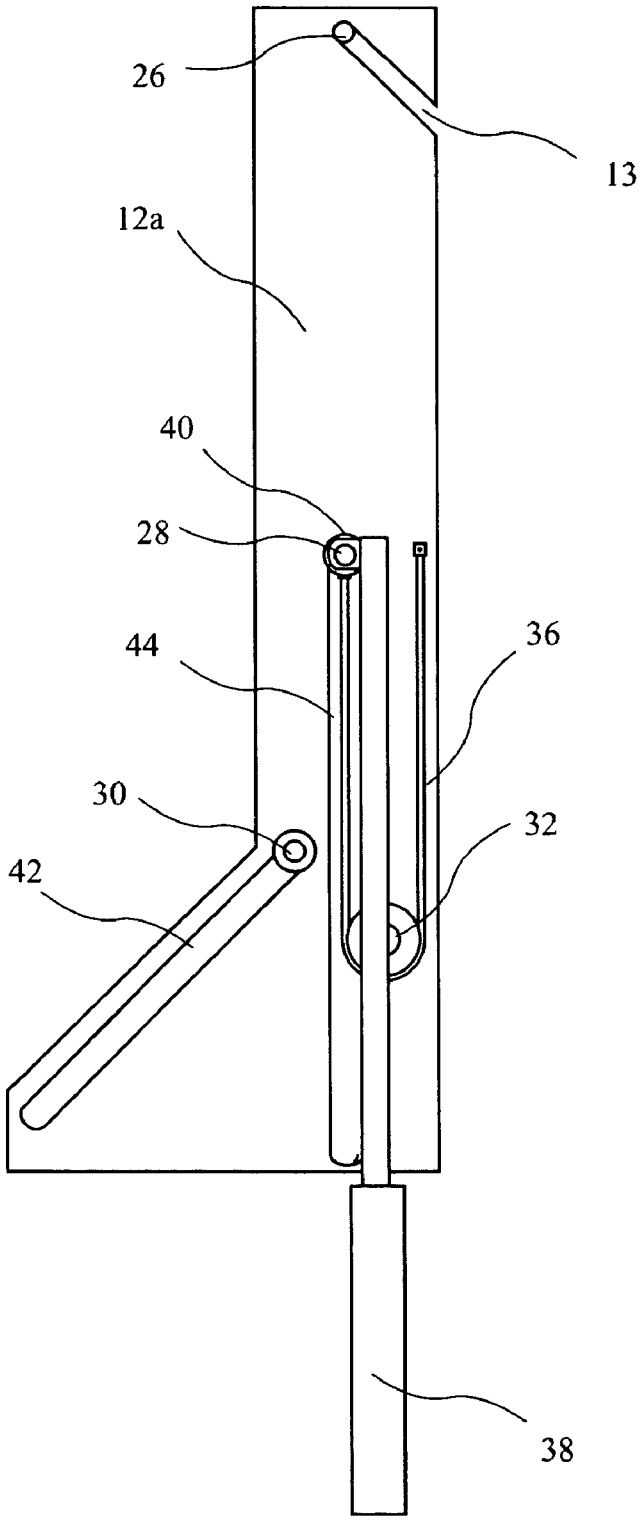
FIG. 9 is a cross-sectional view of the speed barrier taken along line 9-9 of FIG. 6.

A cross-sectional view of the speed barrier 10 taken along line 9-9 of FIG. 6 is shown in FIG. 9. When the gate 16 is in the deployed position, the mid roller 28 is proximal to an upper end of the vertical guide 44 and the bottom roller 30 is proximal to the upper end of the diagonal roller 42.

Figure 10B:
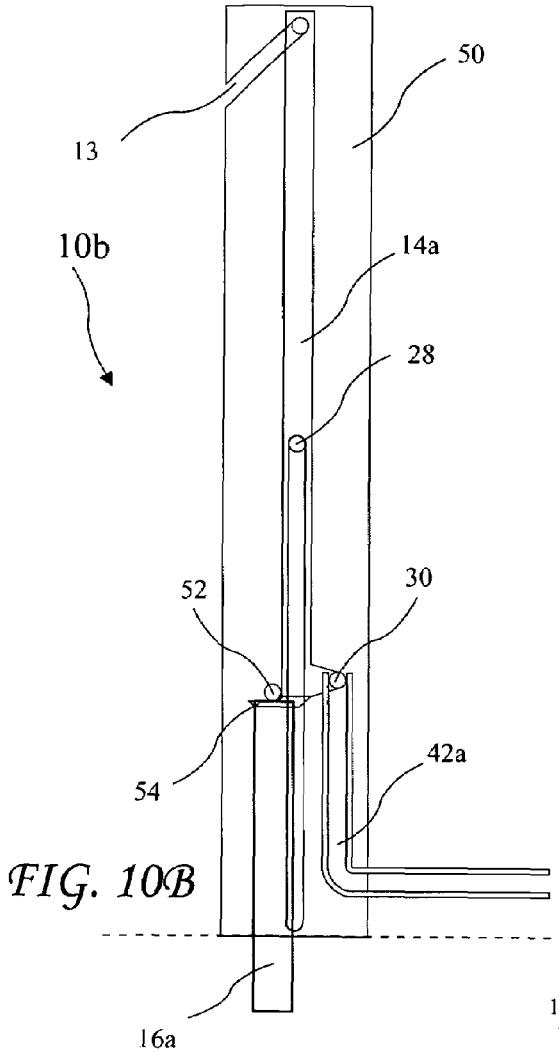
FIG. 10B shown details of the second embodiment of the speed barrier with the gate and barrier in deployed positions.
Figure 10A:
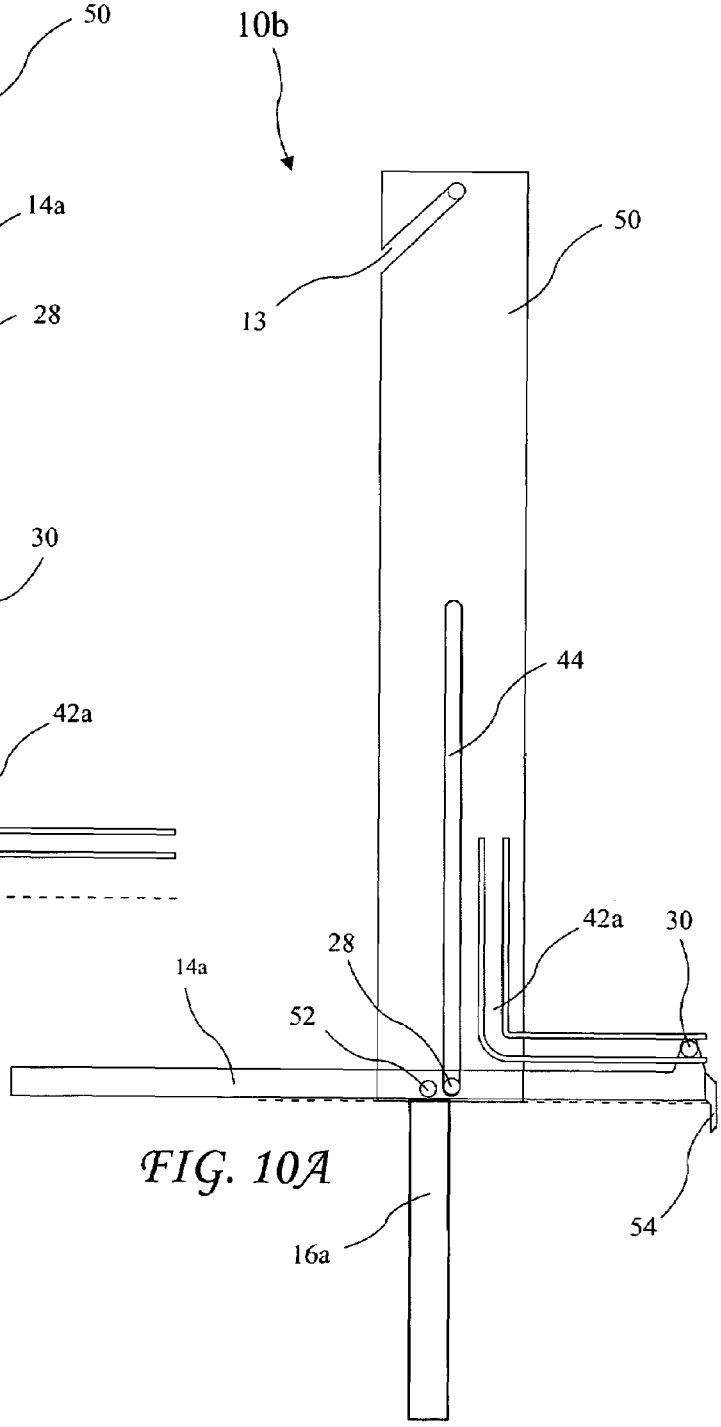
FIG. 10A shown details of a second embodiment of the speed barrier with the gate and barrier in stowed positions.

A second embodiment 10*b* of the speed barrier with a second gate 14*a* and second barrier 16*a* in stowed positions in FIG. 10A, and with the gate 16*a* and barrier 14*a* in deployed positions in FIG. 10B. An "L" track 42*a* replaced the diagonal track 42 and a hook 54 and barrier bar 52 replace the cable 36 and pulley 32 of the first embodiment. The bottom roller 30 initially travels horizontally along the "L" track 42*a* for about half the travel of the gate 14*a*. When the bottom roller 30 reaches the bend in the "L" track 42*a*, the hook 54 engages the barrier bar 52. The remaining motion of the gate 14*a* lifts the barrier 16*a*. The apparent motion of the gate 14*a* and barrier 16*a* is similar to the motion shown if FIGS. 5A, 5B, and 5C, with the exception that the barrier 16*a* does not begin to raise until the gate 14*a* is raised about half way.

Figure 11C:
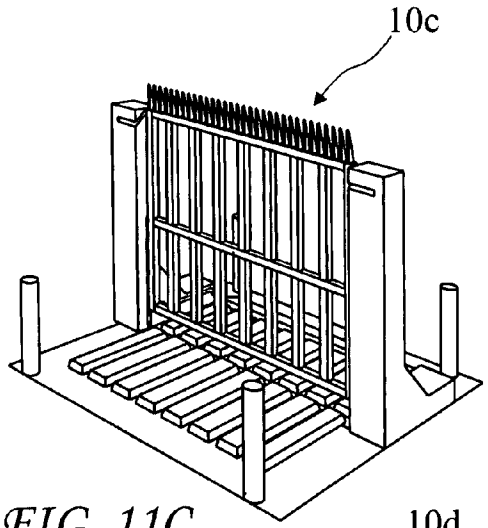
FIG. 11C depicts the third embodiment of the speed barrier with the gate and barrier in deployed positions.
Figure 11B:
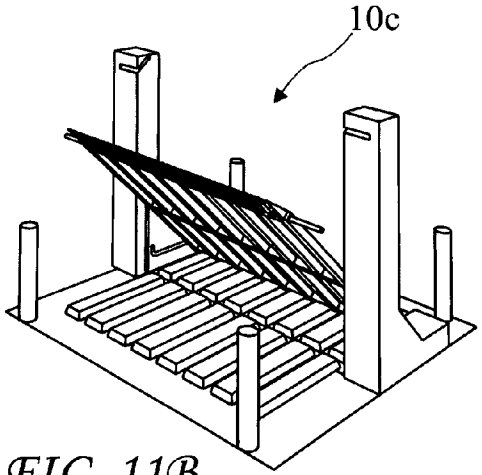
FIG. 11B depicts the third embodiment of the speed barrier with the gate and barrier in intermediate positions.
Figure 11A:
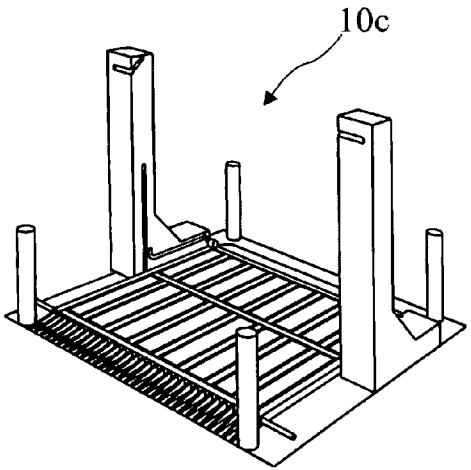
FIG. 11A depicts a third embodiment of the speed barrier with the gate and barrier in stowed positions.

A third embodiment 10*c* of the speed barrier with a third gate 14*c* (see FIGS. 13A and 13B) and no barrier, is shown in the stowed position in FIG. 11A, in intermediate position in FIG. 11B, and in the deployed position in FIG. 11C. The gate 14*c* replaces the combination of a gate and barrier in other embodiments.

Figure 12C:
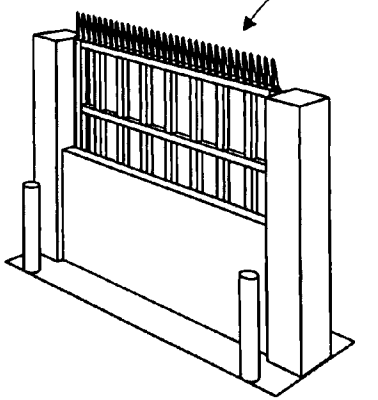
FIG. 12C depicts the fourth embodiment of the speed barrier with the gate and barrier in deployed positions.
Figure 12B:
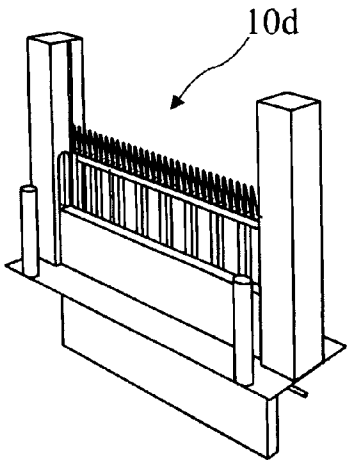
FIG. 12B depicts the fourth embodiment of the speed barrier with the gate and barrier in intermediate positions.
Figure 12A:
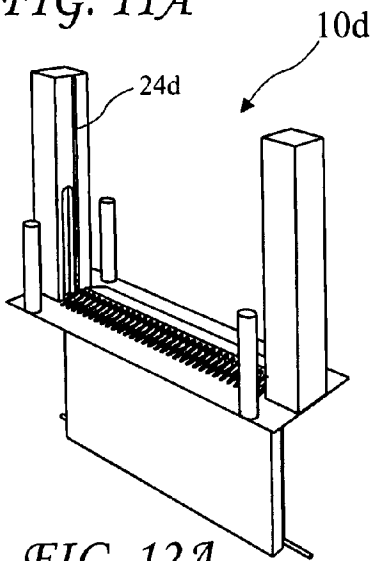
FIG. 12A depicts a fourth embodiment of the speed barrier with the gate and barrier in stowed positions.

A fourth embodiment 10*d* of the speed barrier with a fourth gate 14*d* and fourth barrier 16*d* is shown in stowed positions is shown in FIG. 12A, in intermediate positions in FIG. 12B, and in deployed positions in FIG. 12C. The fourth speed barrier 10*d* comprises a telescoping gate versus a tilting gate as in other embodiments.

Figures 13A, 13B:
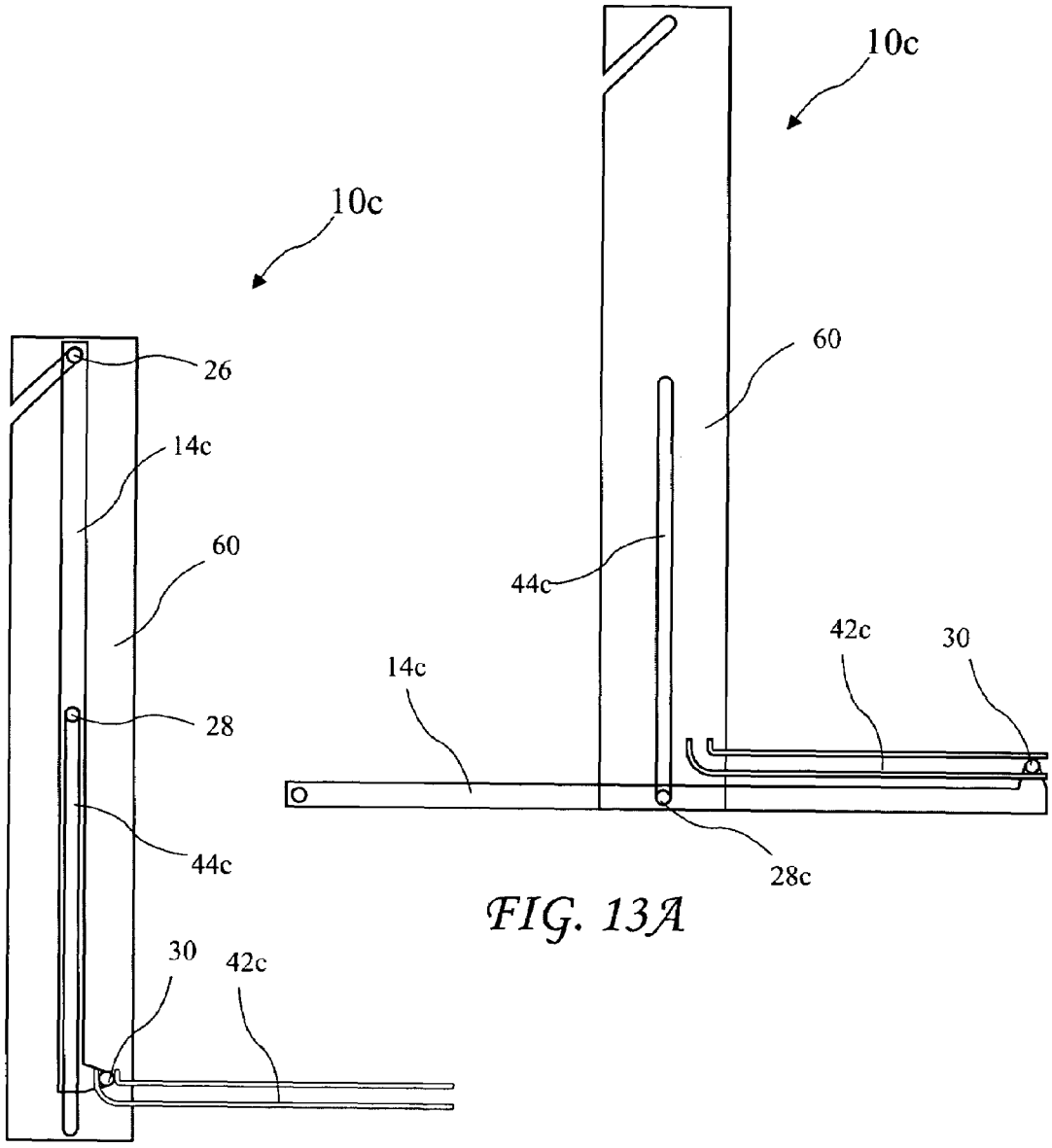
FIG. 13A shown details of the third embodiment of the speed barrier with the gate in the stowed position.
FIG. 13B shown details of a third embodiment of the speed barrier with the gate in the deployed position.

Details of the third embodiment 10*c* of the speed barrier are shown in FIG. 13A with the gate 14*c* stowed, and in FIG. 13B with the gate 14*c* deployed. The gate 14*c* replaces the combination of gate and barrier in other embodiments. A third column 60 includes a vertical track 44*c* extending from the base of the column 60 to approximately the midpoint of the column 60 and the mid roller 28 resides approximately at a mid point of the gate 14*c*. The horizontal track 42*c* guides the bottom roller 30. The gate 14*c* is preferably raised using a linear actuator 38 as describes in FIGS. 8B and 9.

Figure 14A:
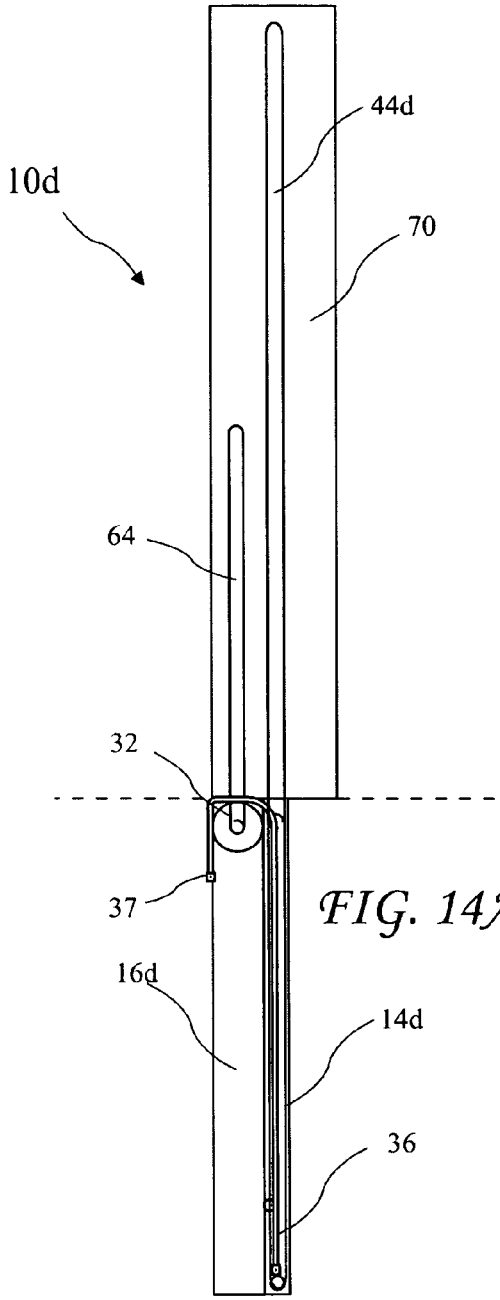
FIG. 14A shown details of a fourth embodiment of the speed barrier with the gate and barrier in stowed positions.
Figure 14B:
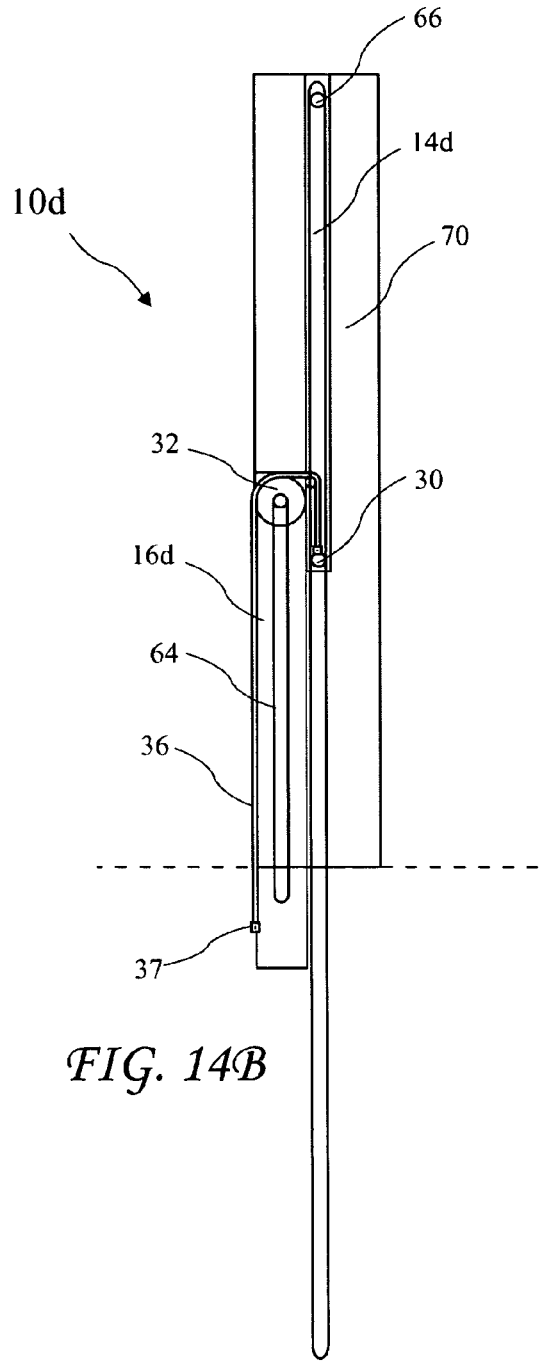
FIG. 14B shown details of the fourth embodiment of the speed barrier with the gate and barrier in deployed positions.

Details of the fourth embodiment 10*d* of the speed barrier with a fourth gate 14*d* and a fourth barrier 16*d* in stowed positions are shown in FIG. 14A and with the gate 14*d* and barrier 16*d* in deployed positions in FIG. 14B. Unlike other embodiments, the gate 14*d* moves vertically between the stowed and deployed positions with substantially no rotation. A fourth column 70 includes a fourth vertical guide 44*d* extending for near the top of the column 70 downward to a point below the driving surface 11 approximately the height of the gate 14*d*. The gate 14*d* includes top rollers 66 and the bottom rollers 30 which both travel in the guide 44*d*. The barrier 16*d* preferably includes rollers or guides which travel in a barrier track 64, or the barrier edges 34 (see FIG. 4) may slide in guides. The cable 36 is attached at a fixed point 37, loops around the barrier pulley 32 (see FIG. 4 also) and attaches to a fixed point on the gate 14*d*. A linear actuator 38 pushes the barrier 16*d* up, and the cable 36 pulls the gate 14*d* up.

While the invention herein disclosed has been described by means of specific embodiments and applications thereof, numerous modifications and variations could be made thereto by those skilled in the art without departing from the scope of the invention set forth in the claims.

I claim:

1. A speed barrier comprising:

a left column;

a right column;

a barrier configured to survive a main impact of a vehicle attempting to ram through the speed barrier and movable between a stowed barrier position and a deployed barrier position, wherein in the deployed barrier position, the barrier resides vertically at a lower column position and is supported by the columns; and a gate movable vertically between a stowed gate position and a deployed gate position, wherein:

the gate includes mid-rollers attached to the gate between an upper end of the gate and a lower end of the gate, the columns include vertical tracks, and the mid-rollers translate along the vertical tracks when the gate moves between the stowed gate position and the deployed gate position;

the gate includes bottom rollers proximal to the lower end of the gate, the columns further include diagonal tracks, and the bottom rollers translate along the diagonal tracks when the gate moves between the stowed gate position and the deployed gate position;

the barrier includes barrier pulleys proximal to a top end of the barrier, cables are attached to the gate proximal to the mid-rollers, the cables extend downward and wrap around the barrier pulleys, and then extend upwards and attach to a fixed point on each column, and vertical motion of the mid-rollers results in the cable lifting the barrier one half the vertical distance the mid-rollers move, and in the deployed gate position the gate resides vertically at an upper column position above the barrier and is supported by the columns.

2. The speed barrier of claim 1, wherein a portion of the barrier remains below a driving surface when the barrier is in the deployed barrier position.

3. The speed barrier of claim 1, wherein:

the gate includes engaging bars proximal to an upper end of the gate;

the columns include mouths proximal to an upper end of each column; and the engaging bars slide into the mouths as the gate is fully deployed to resist motion of the gate when a vehicle rams the gate.

4. The speed barrier of claim 1, wherein the gate resides substantially horizontally when the gate is in the stowed gate position.

5. The speed barrier of claim 1, wherein linear actuators push the gate from the stowed gate position to the deployed gate position.

6. The speed barrier of claim 5, wherein the gate pulls the barrier from the stowed barrier position to the barrier deployed position.

7. The speed barrier of claim 1, wherein the gate has approximately twice the vertical extent in the gate deployed position as the barrier has in the barrier deployed position.

8. A speed barrier comprising:

a left column;

a right column;

a gate movable between a stowed gate position and a deployed gate position, wherein in the deployed gate position, the gate resides vertically at an upper column position corresponding to an upper two thirds of the height of the speed barrier, and is supported by the columns;

a linear actuator attached to the gate for moving the gate from the stowed gate position to the deployed gate position; and a barrier configured to survive a main impact of a vehicle attempting to ram through the speed barrier and connected to the gate and movable between a stowed barrier position and a deployed barrier position, wherein in the deployed position, the barrier resides vertically at a lower column position corresponding to a lower one third of the height of the speed barrier, and is supported by the columns, and wherein the gate pulls the barrier from the stowed barrier position to the deployed barrier position, wherein;

the barrier is coupled to the gate by a pair of cables so that when the gate is raised, the gate pulls the barrier from the stowed barrier position to the barrier deployed position;

a fixed end of each cable is fixed to each of the columns; and an opposite end of each cable is attached to a point on the gate so that when the gate is raised a vertical distance, the barrier is raised one half the vertical distance.

9. A speed barrier comprising:

a left column;

a right column;

a gate movable between a stowed gate position and a deployed gate position, wherein in the deployed gate position the gate resides vertically at an upper column position corresponding to an upper two thirds of the height of the speed barrier and is supported by the columns, and wherein the gate resides substantially horizontally when the gate is in the stowed gate position;

mid-rollers attached to the gate between an upper end of the gate and a lower end of the gate;

vertical tracks attached to the columns, wherein the mid-rollers translate along the vertical tracks when the gate moves between the stowed gate position and the deployed gate position;

linear actuators attached to the gate proximal to the mid-rollers for moving the gate from the stowed gate position to the deployed gate position; and a barrier movable between a stowed barrier position and a deployed barrier position and configured to survive a main impact of a vehicle attempting to ram through the speed barrier, wherein in the deployed position, the barrier resides vertically at a lower column position corresponding to a lower one third of the height of the speed barrier and is supported by the columns, and wherein the gate pulls the barrier from the stowed barrier position to the deployed barrier position, wherein;

the barrier is coupled to the gate by a pair of cables so that when the gate is raised by the linear actuators, the gate pulls the barrier from the stowed barrier position to the barrier deployed position;

a fixed end of each cable is fixed to each of the columns;

the cables loop around pulleys attached to the barrier; and an opposite end of each cable is attached to a point on the gate so that when the gate is raised a vertical distance, the barrier is raised one half the vertical distance.

10. The speed barrier of claim 8, wherein a portion of the barrier remains below a driving surface when the barrier is in the deployed barrier position.

11. The speed barrier of claim 8, wherein:

the gate includes engaging bars proximal to an upper end of the gate;

the columns include mouths proximal to an upper end of each column; and the engaging bars slide into the mouths as the gate is fully deployed to resist motion of the gate when a vehicle rams the gate.

12. The speed barrier of claim 8, wherein the gate resides substantially horizontally when the gate is in the stowed gate position.

13. The speed barrier of claim 8, wherein linear actuators push the gate from the stowed gate position to the deployed gate position.

14. The speed barrier of claim 9, wherein a portion of the barrier remains below a driving surface when the barrier is in the deployed barrier position.

15. The speed barrier of claim 9, wherein:

the gate includes engaging bars proximal to an upper end of the gate;

the columns include mouths proximal to an upper end of each column; and the engaging bars slide into the mouths as the gate is fully deployed to resist motion of the gate when a vehicle rams the gate.

16. The speed barrier of claim 9, wherein the gate resides substantially horizontally when the gate is in the stowed gate position.

17. The speed barrier of claim 9, wherein linear actuators push the gate from the stowed gate position to the deployed gate position.

* * * * *